United States Patent [19]

Berg et al.

[11] Patent Number: 4,770,728

[45] Date of Patent: Sep. 13, 1988

[54] METHOD FOR COATING HIGH ENERGY EXPLOSIVE CRYSTALS

[75] Inventors: Alf Berg; Olav E. Bjørlo; Kåre Ulsteen, all of Saetre i Hurum, Norway

[73] Assignee: Dyno Industrier A.S., Hurum, Norway

[21] Appl. No.: 699,838

[22] Filed: Feb. 8, 1985

[30] Foreign Application Priority Data

Feb. 8, 1984 [NO] Norway ..... 840468

[51] Int. Cl.[4] ..... C06B 45/22

[52] U.S. Cl. ..... 149/11

[58] Field of Search ..... 149/11

[56] References Cited

U.S. PATENT DOCUMENTS

| | | | |
|---|---|---|---|
| 3,138,496 | 6/1964 | Monical | 149/11 |
| 3,485,901 | 12/1969 | Quinlan | 149/11 |
| 3,506,505 | 4/1970 | Herzog | 149/11 |
| 3,980,741 | 9/1976 | Lovold | 149/72 |
| 4,073,977 | 2/1978 | Koester et al. | 149/7 |
| 4,350,542 | 9/1982 | Kincaid et al. | 149/11 |
| 4,389,263 | 6/1983 | Allen | 149/11 |
| 4,428,786 | 1/1984 | Arni | 149/2 |
| 4,430,241 | 2/1984 | Fiorucci | 149/41 |

*Primary Examiner*—Edward A. Miller

*Attorney, Agent, or Firm*—Wenderoth, Lind & Ponack

[57] ABSTRACT

A method for coating high energy explosive crystals is carried out in a fluidized bed apparatus, in which moist explosive crystals are predried and coated with a dispersion of flegmatizing and binding agents injected into said apparatus through nozzles, whereby said explosive crystals form agglomerates and said agglomerates form granules. Water from the dispersion is evaporated and the granules ready for use are discharged.

The method is particularly suitable for coating HMX, RDX and pentrite and may be used on explosive crystals having a grain size of about 1 mm, as well as about 150 microns and even below 20 microns.

The dispersion comprises, as a main ingredient, for instance plastic or wax.

14 Claims, No Drawings

METHOD FOR COATING HIGH ENERGY EXPLOSIVE CRYSTALS

The simplest method for coating explosive crystals with wax or other binding agents or flegmatizing agents consists in the mechanical blending in equipment like that which is used in the bakery industry.

The most common more recent method is the so-called "slurry coating" which consists in stirring a slurry of explosive crystals and coating agents in water by means of a powerful agitator, whereby the coating agents may be brought to cover the crystals, said coating agents being present in molten form or dissolved in a solvent which, subsequently, has to be removed.

More recently, several modifications of the above methods have been proposed, whereby the flegmatizing agent is applied as a dispersion or an emulsion on the explosive crystals.

Norwegian patent application No. 82.1716 (corresponding to U.S. Pat. No. 4,428,786) describes a method of the latter kind. Thus, said application relates to a process for preparing a cold pressable, plastic bonded high energy explosive, one of the characteristic features of said process being the use of a mixing drum for applying coatings on the explosive from an aqueous plastic dispersion.

The drawback of the said claimed process, in particular in the production in greater scale, is that the wet crystals tend to caking, and, consequently, have to be subjected to a specific predrying step while in motion before they can be processed further without sticking together. Naturally, this means longer time and more work and, consequently, also presents difficulties in the selection of suitable apparatus.

Further, the tumbling process according to the said application is tied to the utilization of coarse crystals (magnitude 1 mm). Thus, it is difficult to coat finely grained material, e.g. less than 100 to 200 microns in size, and substantially impossible in the case of a size finer than 20 microns, since it is difficult to make grains of that small size roll in the drum.

The process of the present application is highly suitable also for the coating of fine crystals, i.e., having a grain size essentially below 500 microns.

In the process according to the invention a fluidized bed apparatus is used. From the prior art it is known to employ such apparatus for coating and drying various materials; however, with respect to the coating of explosives, and in particular plastic coating of high energy explosives, such apparatus has not been used previously, i.a., due to explosion hazard because of building up of static electricity in said apparatus.

In the experiments on which the present invention is based applicants have employed an Aeromatic Fluid Bed Spray Granulator, laboratory model. With such an apparatus it takes less than one hour to carry out a coating operation, while this, for instance in the process according to Norwegian patent application No. 82.1716, takes a much longer time and, additionally, manual operations are required. The product produced herein corresponds to what is provided by the process of the said application. The present process, however, possesses the further advantage that the entire process takes part in one and the same apparatus.

Thus, the present process involves coating as well as granulating and drying crystallinic high-energy explosives, said process being characterized in that into a fluidized bed apparatus, moist explosive crystals are fed that are maintained in a floating condition due to the air pressure, whereby the crystals are predried, a dispersion of flegmatizing and binding agents is sprayed into the apparatus through nozzles, the crystals thereby being coated with the dispersion, in such way that agglomerates are created, and said agglomerates are formed into granules of the desired size, the water from the dispersion is evaporated and the granules ready for use are discharged. The present process is suitable for coating high energy explosives such as HMX (octogen), RDX (hexogen) and pentrite (tetranitropentaerythritol). In particular, this process is preferred for the coating of HMX crystals having a grain size essentially below 1 mm, for instance less than 200 microns and even less than 20 microns.

The dispersion that is used in the coating process of the present invention, preferably consists substantially of an aqueous dispersion of synthetic resin, possibly wax. Moreover, in addition the dispersion may contain, as an ingredient of the flegmatizing agent, graphite which serves as a slip agent.

The weight proportions for charging into the having fluidized bed apparatus, preferably, will be 85 to 99% of high-energy exposive crystals and 10 to 1% of total flegmatizing agent (including slip agent and plasticizer, if any) and binding agent, for instance 96% of HMX crystals and 4% of flegmatizing and binding agents.

The following examples will illustrate the invention, without in any way limiting the scope thereof.

General description of the process

Moist explosive crystals are weighed and charged into the fluidized bed apparatus, in the following named granulator, viz., an Aeromatic Fluid Bed Spray Granulator (laboratory model). With said explosive crystals is charged, if desired, metal powder of, e.g., aluminum or magnesium, which in such case has to be passivated (stabilized) in order to tolerate water, e.g., aluminum powder passivated with isostearic acid, potassium dichromate or phosphate.

In the granulator, pressure, temperature and air inlet are set at the desired values, and the moist explosive crystals are predried by being kept floating in the fluidized bed.

The binding agent and flegmatizing agent components are dispersed in water, as described in application No. 82.1716, which is hereby incorporated by reference. The dispersion is charged into the granulator when the explosive crystals have achieved a suitable movement, optionally after further diluting the dispersion with water.

Charging of the said dispersion may take place in two portions. The air inlet and nozzle pressure are lowered, and thereafter the post-drying starts. When the latter is considered finished, the container is left for 10 to 15 minutes, whereafter the coated explosive is discharged, being then ready for use, i.e., for being formed by compaction.

In the dispersions utilized in the example, components were included that were selected from the following: polyacrylates, polybutylacrylates, polyethylene, Teflon, silica gel, wax (paraffin wax and Montan wax), calcium carbonate, aluminum, graphite and calcium sulphate.

EXAMPLE 1

Coating of HMX crystals, class D (about 1 mm) Ingoing crystals, sieve analysis; % through US sieve No. (grain size, microns)

| US sieve No. microns | 12 (1680) | 35 (500) | 50 (297) | 100 (149) | 200 (74) | 325 (44) |
|---|---|---|---|---|---|---|
| % | 100 | 27 | 7 | 1 | 1 | 1 |

Coating agent:

White dispersion of polyacrylate, to which have been added flegmatizing and stabilizing agents (cf. application No. 82.1716). Moist HMX, 1 kg dry substance, was charged into the granulator.

From 200 grams of previously prepared binding agent dispersion (43.3% dry substance), diluted with additional 60 grams of water, the injection was carried out under the following conditions:

| Temperature: | Ingoing air 65° C. Outgoing air about 40° C. | | |
|---|---|---|---|
| | Part 1 | Part 2 | |
| Predrying, time | 4 mins. | 0 mins. | |
| Charging, time | 5.5 mins. | 5 mins. | |
| Postdrying, time | 11.5 mins. | 10 mins. | |
| Charging, amount | 71.4 grams | 64.8 grams = | total 136.2 grams |

The finished granules had 4.18% of binding agent and the following grain size distribution:

Above 1 mm: 18%
0.5–1.0 mm: 32%
0.3–0.5 mm: 43%
0.15–0.3 mm: 7%

The product was well suited for compaction by cold pressing into explosive charges for ammunition.

EXAMPLE 2

HMX crystals, class A/C (about 0.25 mm) Ingoing crystals, sieve analysis, through US sieve:

| US sieve | 12 | 35 | 50 | 100 | 200 | 325 |
|---|---|---|---|---|---|---|
| % | 100 | 99 | 59 | 30 | 8 | 5 |

Coating agent:

Black dispersion of polyacrylate and flegmatizing agent including graphite (cf. application No. 82.1716).

Moist HMX, 1 kg dry substance, was charged into the granulator. From 222 grams of plastic dispersion, with 30% dry substance, with 120 ml additional water, the operation was carried out as follows:

| Temperature: | Ingoing air 80–90° C. Outgoing air about 25–45° C. | | |
|---|---|---|---|
| | Part 1 | Part 2 | |
| Predrying, time | 9 mins. | 0 mins. | |
| Charging, time | 7 mins. | 6 mins. | |
| Postdrying, time | 4 mins. | 4 mins. | |
| Charging, amount | 147.0 grams | 126.1 grams = | total 273.1 grams |

The finished granules had 4.17% of binding agent, calculated on the granules, and the following grain size distribution:

Above 0.5 mm: 3%
0.3–0.5 mm: 62%
0.15–0.3 mm: 26%
0.074–0.15 mm: 9%

The product was readily compressible and the test charge had the required mechanical properties, density and compression strength.

EXAMPLE 3

As in Example 2, however, the coating was carried out with an ingoing air temperature of 100° C.

HMX crystals, class A/C (about 250 microns), sieve analysis, through US sieve:

| US sieve | 35 | 50 | 100 | 200 |
|---|---|---|---|---|
| % | 100 | 73 | 25 | 7 |

Coating agent:

Black polyacrylate dispersion, amount and dilution as in Example 2. Moist HMX, 1 kg dry substance, charged into the granulator, at ingoing air of 100° C., corresponding outgoing air of 25°–40° C., according to the following scheme:

| | Part 1 | Part 2 | |
|---|---|---|---|
| Predrying, time | 5 mins. | 0 mins. | |
| Charging, time | 5 mins. | 4 mins. | |
| Postdrying, time | 5 mins. | 10 mins. | |
| Charging, amount | 127.4 grams | 99.5 grams = | total 226.9 grams |

The achieved granules were satisfactory, comprising 4.1% of binding agent and with the following sieve analysis:

Above 1.0 mm: 1.6%
0.5–1.0 mm: 30%
0.3–0.5 mm: 41%
0.15–0.3 mm: 25%
0.074–0.15 mm: 3%

Test charges, comprimed from said granulate, showed excellent quality.

EXAMPLE 4

As in Example 2, however, charging 1.56 kg wet HMX (1.5 kg dry substance), and the coating was carried out at 100° C.

HMX crystals as in Example 3.

| | Part 1 | Part 2 | |
|---|---|---|---|
| Predrying, time | 7 mins. | 0 mins. | |
| Charging, time | 8 mins. | 8 mins. | |
| Postdrying, time | 5 mins. | 25 mins. | |
| Charging, amount | 192.7 grams | 194.7 grams = | total 387.4 grams |

The granules obtained were satisfactory and comprised 4.4% of binding agent.

The sieve analysis showed the following size of granules:

Above 1 mm: 0.3%
0.5–1.0 mm: 23%
0.3–0.5 mm: 44%
0.15–0.3 mm: 28%
0.074–0.15 mm: 5%
Below 0.074 mm: 1%

EXAMPLE 5

As in Example 2, however, charging 2.09 kg wet HMX (2.0 kg dry substance).

HMX crystals as in Examples 3 and 4.

| | Part 1 | Part 2 | |
|---|---|---|---|
| Predrying, time | 15 mins. | 0 mins. | |
| Charging, time | 9 mins. | 8 mins. | |
| Postdrying, time | 6 mins. | 22 mins. | |
| Charging, amount | 254.5 grams | 228.7 grams = | total 483.2 grams |

The granules obtained were satisfactory and comprised 4.0% of binding agent.

The sieve analysis showed the following size of granules:

Above 1 mm: 1.3%
0.5–1.0 mm: 9%
0.3–0.5 mm: 37%
0.15–0.3 mm: 41%
0.074–0.15 mm: 10%
Below 0.074 mm: 2%

EXAMPLE 6

HMX crystals, class A (about 0.2 mm), with the following sieve analysis; % through US sieve No.:

| US sieve | 35 | 50 | 100 | 200 | 325 |
|---|---|---|---|---|---|
| % | 100 | 99 | 40 | 7 | 4 |

This charge is 222 grams of black acrylate binding agent (as in Example 2) mixed with 222 grams of water (i.e. a dilution of 1:1)

Ingoing air temperature 100° C.

| | Part 1 | Part 2 | |
|---|---|---|---|
| Predrying, time | 7 mins. | 0 mins. | |
| Charging, time | 5 mins. | 5 mins. | |
| Postdrying, time | 8 mins. | 15 mins. | |
| Charging, amount | 160.0 grams | 161.2 grams = | total 321.2 grams |

The granules were satisfactory, having 3.6% binding agent, and gave the following sieve analysis:

Above 1 mm: 0.2%
0.5–1.0 mm: 7.4%
0.3–0.5 mm: 18.8%
0.15–0.3 mm: 53.5%
0.074–0.15 mm: 19.2%
Below 0.074 mm: 1.7%

The quality was well suited for compaction to shaped charges.

EXAMPLE 7

As in Example 6, however, charging ingoing HMX below 0.100 mm average level. HMX crystals having the following sieve analysis:

| US sieve | 35 | 50 | 100 | 200 | 325 |
|---|---|---|---|---|---|
| % | 100 | 98 | 80 | 20 | 6 |

The coating, with black acrylate dispersion, was carried out with b 0.5 kg as well as with 1.0 kg of HMX dry substance, for the rest similar to Example 6.

| | Part 1 | | Part 2 | |
|---|---|---|---|---|
| | 0.5 kg | 1.0 kg | 0.5 kg | 1.0 kg |
| Predrying, time | 9 mins. | 15 mins. | 0 mins. | 0 mins. |
| Charging, time | 3 mins. | 6 mins. | 2 mins. | 5 mins. |
| Postdrying, time | 3 mins. | 4 mins. | 8 mins. | 15 mins. |
| Charging, amount | 93.9 grams | 167.2 grams | 61.6 grams | 144.8 grams |

Both granulates gave a satisfactory result and had the following sieve analysis:

| | 0.5 kg charge | 1.0 kg charge |
|---|---|---|
| Above 1 mm | 0.5% | 1.0% |
| 0.5–1.0 mm: | 20.6% | 9.0% |
| 0.3–0.5 mm: | 32.8% | 31.0% |
| 0.15–0.3 mm: | 38.0% | 40.0% |
| 0.074–0.15 mm: | 8.0% | 17.0% |
| Below 0.074 mm: | 0.6% | 2.0% |

EXAMPLE 8

Test with synthetic resin bonded "Hexal", consisting of RDX, aluminum powder and polybutyl acrylate.

RDX—grain size:
99% <0.5 mm
54% <0.3 mm
13% <0.15 mm
6% <0.074 mm 953 grams of wet RDX (810 grams dry substance) and 160 grams of passivated Al powder were charged in the granulator.

This ws premixed: 150 grams of a plastic dispersion of polybutyl acrylate with graphite+75 grams of water.

The coating was carried out at a temperature of 80° C. (ingoing air), outgoing air 30°–40° C.

| | Part 1 | Part 2 | |
|---|---|---|---|
| Predrying, time | 15–20 mins. | 0 mins. | |
| Charging, time | 3.5 mins. | 3 mins. | |
| Postdrying, time | 6.5 mins. | 7 mins. | |
| Charging, amount | 68 grams | 72 grams = | total 140 grams |

The finished granules had the following composition:
82.2% RDX,
4.7% binding agent, and
13.1% aluminum The granules:

| | |
|---|---|
| >0.841 mm: | 2.6% |
| 0.595–0.841 mm: | 4.3% |
| 0.420–0.595 mm: | 32.2% |
| 0.300–0.420 mm: | 35.5% |
| 0.15–0.3 mm: | 22.4% |

-continued

| |
|---|
| <0.15 mm: 3.0% |

The quality corresponded to the advance requirements.

EXAMPLE 9

HMX/Wax

HMX, (class C) having the following sieve analysis, % through sieve No.

| US sieve | 35 | 50 | 100 | 200 | |
|---|---|---|---|---|---|
| % | 100 | 67 | 22 | 3 | 1 kg dry substance |

This one is coated with a commercial type KLE wax having 30% of dry substance and which may be sprayed directly in without having been diluted with water.

Parameters as in Example 6, except the thermostate: 60° C. Ingoing air, van velocity setting: Part 1: 4, Part 2: 3/2

Outgoing air: 39°–43° C.

Pump setting: 3.5: 24.2–25.3 grams per minute.

| | Part 1 | Part 2 | |
|---|---|---|---|
| Predrying, time | 5 mins. | 0 mins. | |
| Charging, time | 3 mins. | 3 mins. | |
| Postdrying, time | 7 mins. | 27 mins. | |
| Charging, amount | 69.6 grams | 69.1 grams = | total 138.7 grams |

Result: The granules were satisfactory, wax content 3.9%.

Sieve analysis, granules, % through sieve No.:

| US sieve | 18 | 35 | 50 | 100 | 200 | Bottom |
|---|---|---|---|---|---|---|
| % | 1.4 | 8.1 | 63.7 | 24.4 | 2.4 | 0 |

% moisture: 0.13 (Karl Fischer)

EXAMPLE 10

As in Example 7—1.0 kg charge, however charging a reduced dilution of the dispersion.

All parameters as in Example 7, except admixing of 120 grams of $H_2O$ instead of 222 grams. Similar ingoing HMX used.

Result:

Size of granules compared to previous example with a higher water content in the polyacrylate dispersion:

| US sieve | 18 | 35 | 50 | 100 | 200 | Bottom | Composition % Binding agent |
|---|---|---|---|---|---|---|---|
| Example 7, % | 1.0 | 9.0 | 31.0 | 40.0 | 17.0 | 2.0 | 4.1 |
| Example 10, % | 0.2 | 7.7 | 19.6 | 40.0 | 27.4 | 5.0 | 4.0 |

EXAMPLE 11

Test with plastic bonded "Hexal-30", consisting of RDX/Al/polybutyl acrylate of ratio 66.5/30.0/3.5.

RDX—grain size:

96%<0.5 mm

41%<0.3 mm

14%<0.15 mm

7%<0.074 mm 715 grams of wet RDX (665 grams of dry substance) and 320 grams of aluminum powder, passivated with 0.3% of isostearic acid, were charged into the granulator.

150 grams of plastic dispersion, 30% of dry substance, containing butylacrylate with flegmatizers and lubricants, as above, including graphite, were premixed; the dispersion was diluted with 150 grams of water.

The coating was carried out at an ingoing air temperature of 80° C. (thermostate), outgoing air 30°–40° C.

| | Part 1 | Part 2 | |
|---|---|---|---|
| Predrying, time | 5–10 mins. | 0 mins. | |
| Charging, time | 3 mins. | 2.5 mins. | |
| Postdrying, time | 6 mins. | 7.5 mins. | |
| Charging, amount | 133.7 grams | 110.8 grams = | total 244.5 grams |

The finished granules had the desired properties.

Test with sieve analysis of the granules:

| |
|---|
| >0.841 mm: 2% |
| 0.595–0.841 mm: 3% |
| 0.420–0.595 mm: 38% |
| 0.300–0.420 mm: 25% |
| 0.150–0.300 mm: 24% |
| 0.074–0.15 mm: 5% |
| <0.074 mm: 2% |

We claim:

1. A method for the production of coated high energy explosive crystals which comprises predrying moist explosive crystals by introducing said moist explosive crystals into a fluidized bed apparatus said crystals being suspended in said apparatus due to the air pressure therein, bringing the thus predried crystals, while in a suspended state in the same fluidized bed apparatus, into contact with a dispersion of flegmatizing and binding agent by injecting said dispersion through nozzles into said fluidized bed apparatus, to thereby coat said crystals with said dispersion, maintaining the thus coated crystals in a suspended state in said fluidized bed apparatus so that said coated crystals initially form agglomerates which, in turn, form granules and so that water present in said dispersion is evaporated and discharging the thus formed granules from the said fluidized bed apparatus.

2. A method according to claim 1 wherein the explosive is HMX.

3. A method according to claim 1 wherein the explosive in RDX.

4. A method according to claim 1 wherein the explosive is pentrite.

5. A method according to claim 1 wherein the explosive is HMX having a grain size of about 1 mm.

6. A method according to claim 1 wherein the explosive in HMX having a grain size of about 150 microns.

7. A method according to claim 1 wherein the explosive has a grain size of below 20 microns.

8. A method according to claim 1 wherein the dispersion substantially consists of plastic dispersed in water.

9. A method according to claim 1 wherein the dispersion substantially consists of wax, dispersed in water.

10. A method according to claim 1 wherein said dispersion also contains graphite as a slip agent.

11. A method according to claim 1 wherein passivated metal powder is introduced with said moist explosive crystals.

12. A method according to claim 11 wherein the passivated metal powder is aluminum powder.

13. A method according to claim 1 wherein the weight proportions of materials introduced into the fluidized bed apparatus are 90 to 99% by weight of high energy explosive crystals and 10 to 1% by weight of dispersion.

14. A method according to claim 13 wherein 96% by weight of HMX crystals and 4% by weight of dispersion are employed.

* * * * *